US006606021B2

(12) United States Patent
Chen

(10) Patent No.: US 6,606,021 B2
(45) Date of Patent: Aug. 12, 2003

(54) DEVICE FOR FIXING THE MAGNETIC COIL OF DRIVE UNIT

(75) Inventor: Yongda Chen, Shenzhen (CN)

(73) Assignees: Valley Wood Limited, Hong Kong (CN); China National Electronics IMP & EXP Corporation, Beijing (CN)

( * ) Notice: Subject to any disclaimer, the term of this patent is extended or adjusted under 35 U.S.C. 154(b) by 49 days.

(21) Appl. No.: 09/983,642

(22) Filed: Oct. 25, 2001

(65) Prior Publication Data

US 2002/0075757 A1 Jun. 20, 2002

(30) Foreign Application Priority Data

Nov. 2, 2000 (CN) ..... 00 2 57409 U

(51) Int. Cl.[7] ..... H01F 27/30

(52) U.S. Cl. ..... 336/198; 336/208; 336/110; 336/200

(58) Field of Search ..... 600/360, 684, 600/685, 679; 336/200, 110, 83, 192, 208, 198

(56) References Cited

U.S. PATENT DOCUMENTS 4,288,771 A * 9/1981 Ueda et al. ..... 335/230

FOREIGN PATENT DOCUMENTS

JP 11-125758 * 11/1999
JP 112520 A * 12/2002

* cited by examiner

*Primary Examiner*—Anh Mai
(74) *Attorney, Agent, or Firm*—Lowe Hauptman Gilman & Berner, LLP

(57) ABSTRACT

The present utility model belongs to domestic appliances, especially to devices for fixing the magnetic coil of drive unit in tape recorders, video players or cameras. Two coil bobbin brackets (2) having at least one bobbin hook (2-1) on each of them are mounted on the chassis (50) in their corresponding locking slots. A magnetic coil (3) is mounted between the two coil bobbin brackets (2). A planger (1) is mounted adjacent to one end of the magnetic coil (3), and close to the other end, a magnet (6) is mounted. Moreover at least one coil positioning pin (4) is mounted on that bobbin bracket (2), close to which the magnet 6 is mounted on the magnet bracket (5). The present utility model is simple in structure, costs low, and has a high productivity. The pushing force for the planger (1) is increased, and the utility of the products is improved.

3 Claims, 4 Drawing Sheets

DEVICE FOR FIXING THE MAGNETIC COIL OF DRIVE UNIT

The present utility model belongs to domestic appliances, especially to devices for fixing the magnetic coil of drive unit in tape recorders, video players or cameras.

At present, there are various kinds of tape recorders in the market, but their devices for fixing the magnetic coil of drive unit in the tape recorders, video players or cameras mostly have four holes on the chassis (50), on which a bracket (5) is mounted by four screws 7. Then the magnetic coil (3) is fixed on the bracket (5) by a planger positioning pin (8). In such a case, the aim is achieved that the magnetic coil (3) is fixed on the chassis (50), see FIG. 3 and FIG. 4. In this device, many components are needed to fix the magnetic coil on the chassis (50), that results in a high production cost; and makes the assembly of the magnetic coil more tedious and complicated because of the numerous parts, that results in a reduction of the productivity. In addition, the planger positioning pin (8) currently used in the device for fixing the magnetic coil of drive unit in tape recorders, video players or cameras is a nonmagnetic body, which can not increase the magnetism when the coil is electrified. Therefore, the coil needs more copper wires to increase the magnetic flux and achieve the goal of producing a strong magnetic field, so as to have enough force to move the planger. In such a case, the coil be wounded more windings, and the production cost is increased.

The aim of the present utility model is to provide a new device for fixing the magnetic coil of drive unit to overcome the disadvantages of complicate assembly and high production cost of the current device for fixing the magnetic coil of drive unit in tape recorders, video players or cameras. This utility model is simple in structure, easy to be assembled and the cost of the production is low.

The aim of the present utility model is fulfilled through the followings:

The present utility model comprises a chassis, two coil bobbin brackets, and a magnetic coil, wherein, each coil bobbin bracket (2) having at least one bobbin bracket hook (2-1) on each of them are mounted on the chassis (50), the chassis has two locking slots. A magnetic coil (3) is mounted between the two coil bobbin brackets (2). A planger (1) is mounted adjacent to one end of the magnetic coil (3), and close to the other end, a magnet (6) is mounted.

Moreover a coil positioning pin (4) is mounted on that coil bobbin bracket (2), close to which the magnet (6) is mounted on the magnet bracket (5). The said bobbins are fixed by hooking their corresponding slots and the bracket hooks (2-1).

The present utility model has the following advantages:

It is simple in structure and easier to be assembled. Therefor, it has higher productivity and low production cost. In addition, the pushing force for the planger is increased without the increase of the windings of the coil.

Below is a further description of the technical scheme of this utility model in connection with the appended figures and the embodiment.

| | | | |
|---|---|---|---|
| 1. Planger | 2. Bobbin | 2-1. | Bobbin hook |
| 3. Magnetic Coil | 4. Coil shaft | 5. | Magnet bracket. |
| 6. Magnet | 7. Fastening screw | 8. | Planger positioning pin |
| 50. Chassis. | | | |

The Embodiment

Figure 1:
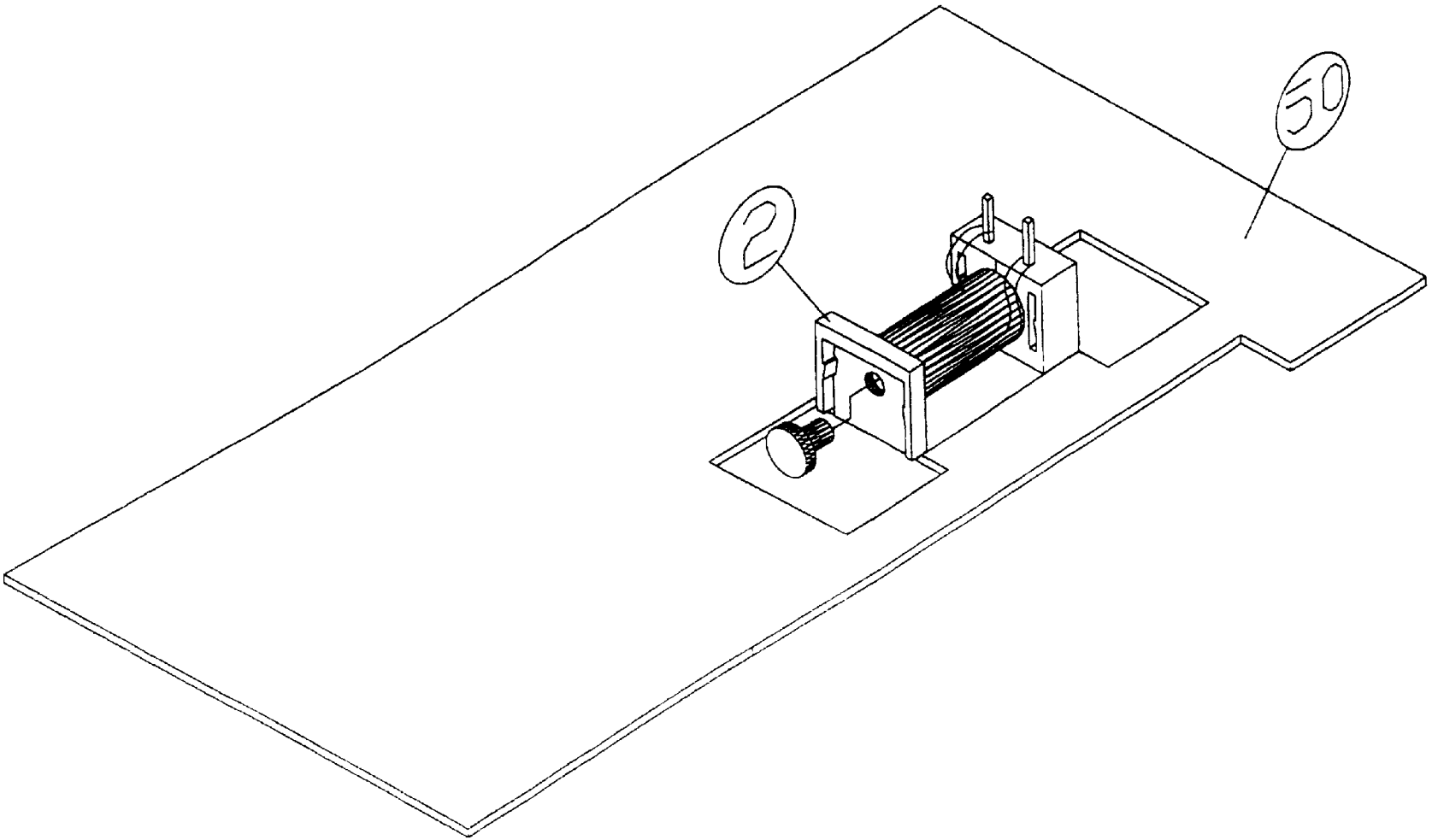
FIG. 1 is a schematic view of this utility model after assembly.
Figure 2:
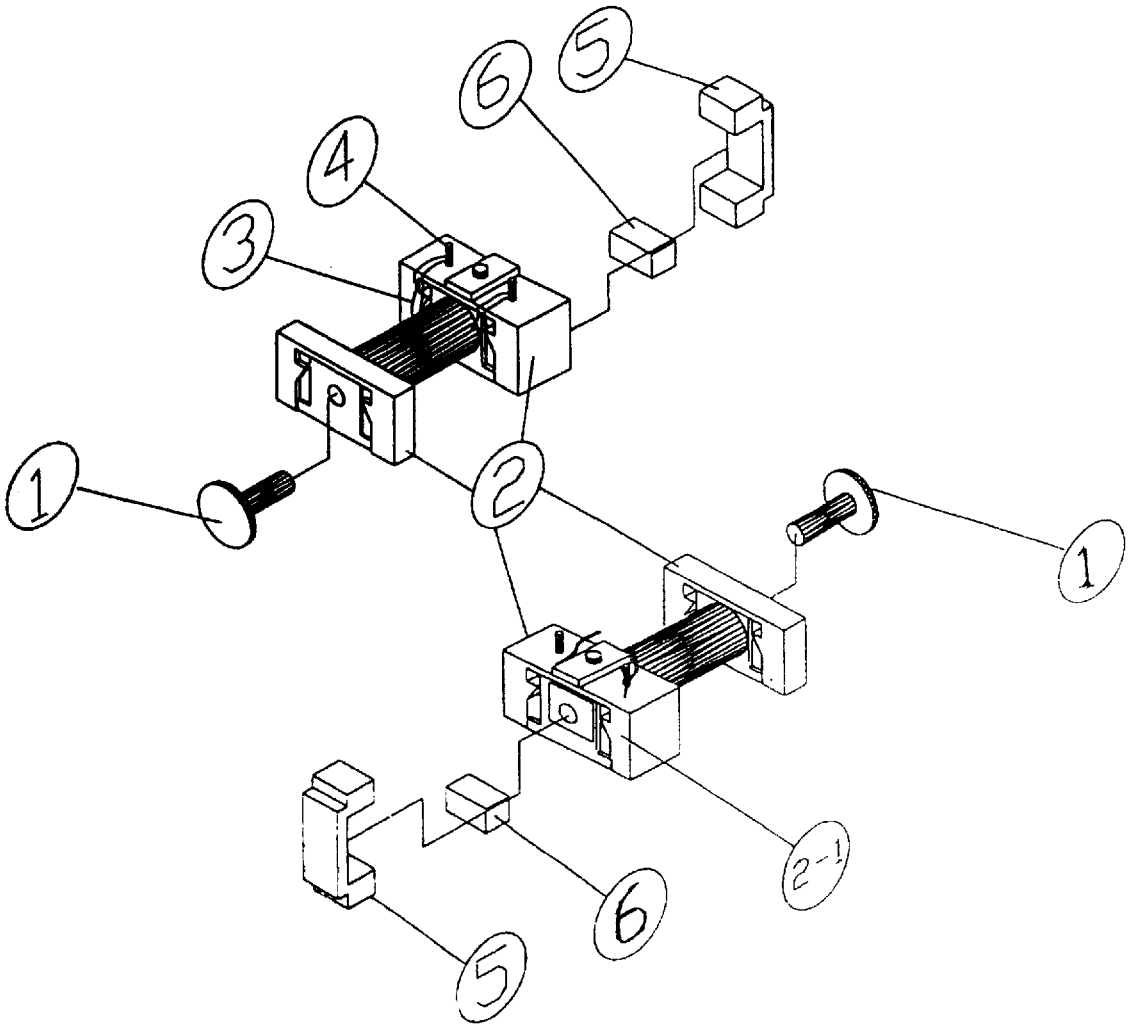
FIG. 2 is a exploded view of this utility model.
Figure 3:
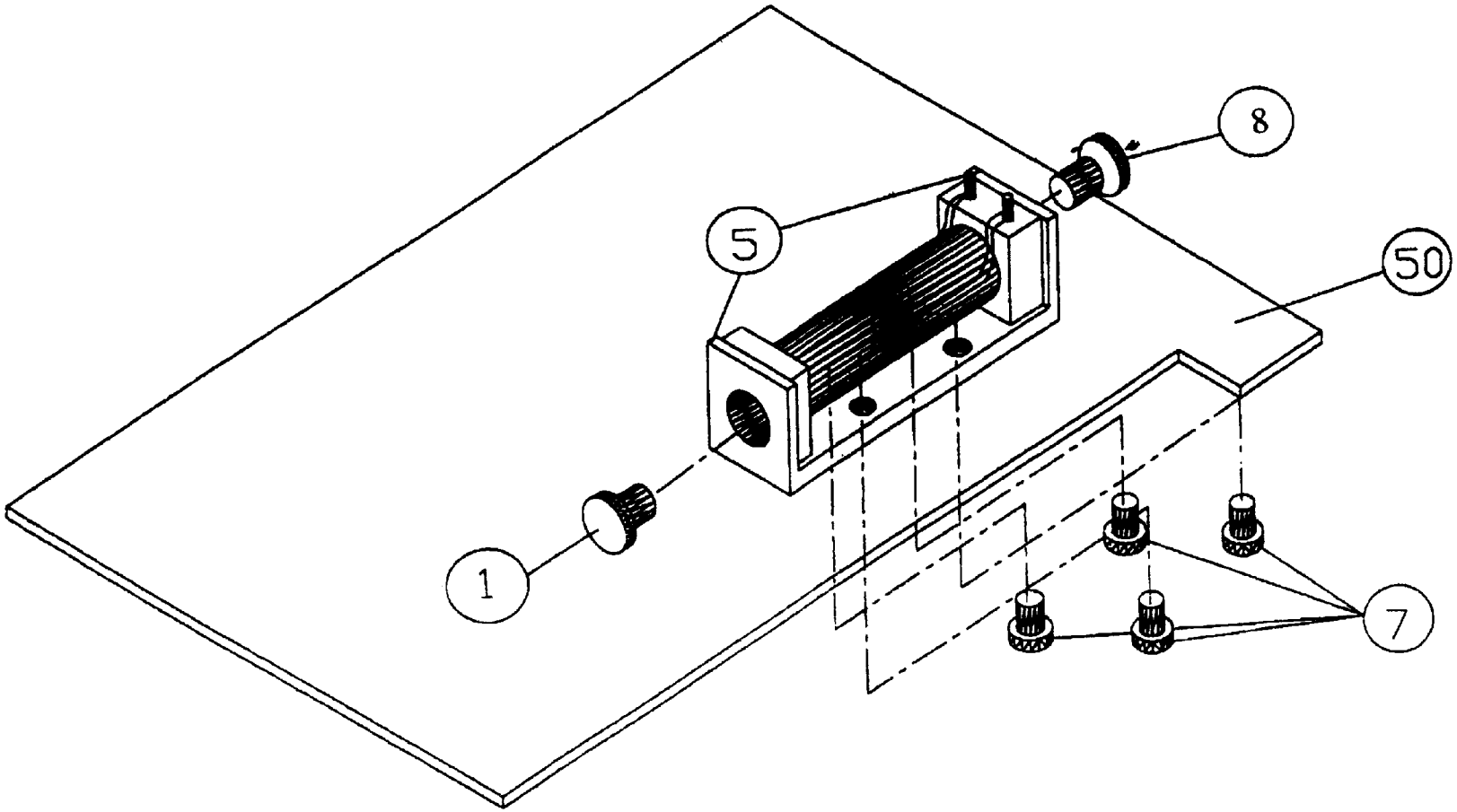
FIG. 3 is a schematic view of a current device for fixing the magnetic coil of drive unit.
Figure 4:
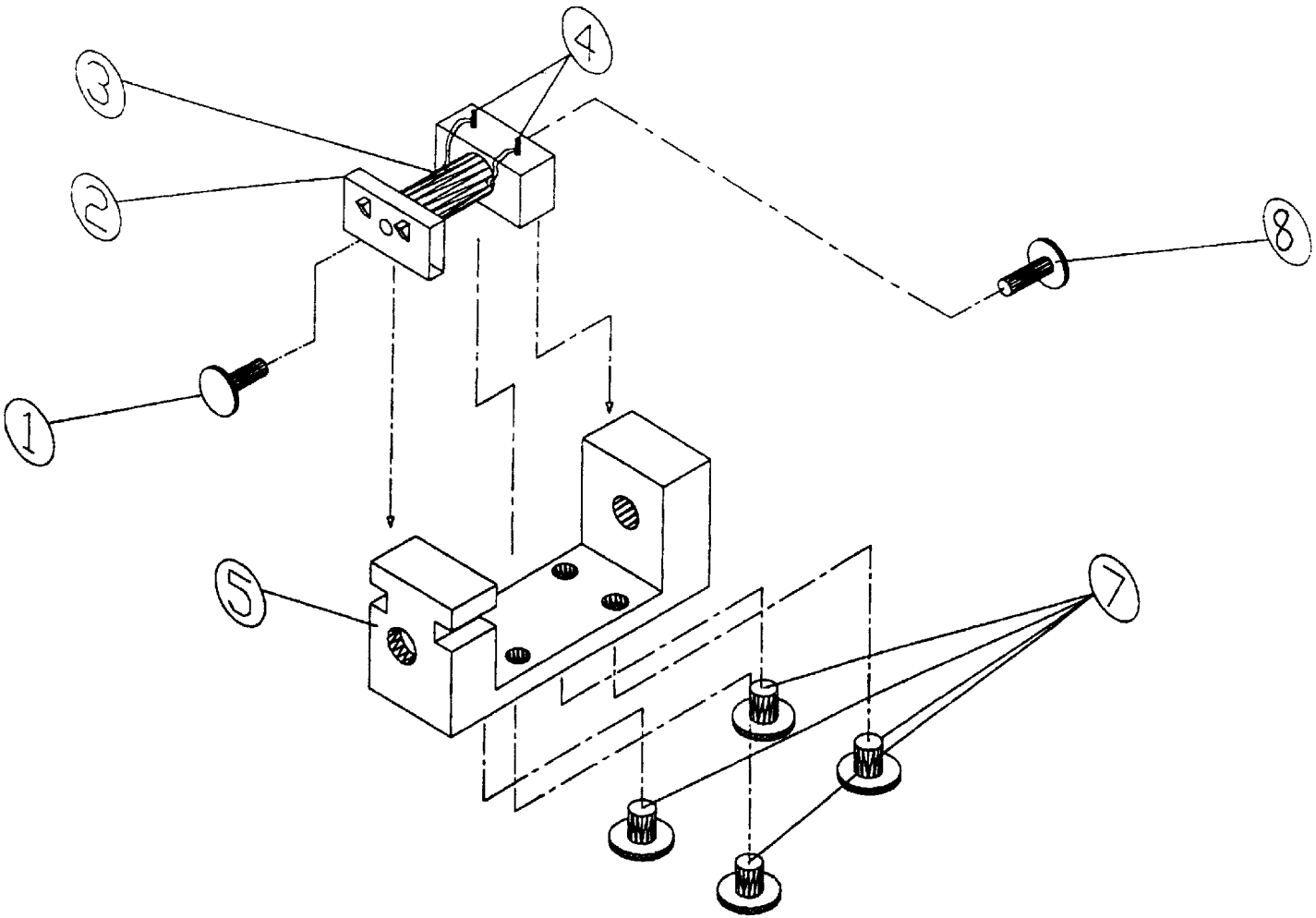
FIG. 4 is a schematic exploded view of the device in FIG. 3 for fixing the magnetic coil of drive unit.

See FIGS. 1 & 2. Two fixing slots are provided on the chassis (50) of a tape recorder. By locking the locking slot and two magnetic coil bobbin bracket hooks (2-1) fixed on the magnetic coil bobbin bracket (2) together, the magnetic coil bobbin bracket is positioned on the chassis (50). Between the two magnetic coil bobbin bracket (2), a magnetic coil (3) is mounted. The magnetic coil (3) is positioned by the two coil positioning pins (4). The planger (1) is mounted adjacent to one end of the magnetic coil (3), and close to the other end, a magnet (6) is mounted on the magnet bracket (5), and the bracket (5) and the magnetic coil bobbin bracket (2) are fixed together. Since the magnet (6) is used instead of the prior nonmagnetic planger positioning pin (8), the magnetism of the coil for pushing the planger is increased, without the increase of the windings of the coil.

While this utility model has been described with reference to the figures and embodiments, it will be understood that various changes within the spirit and scope of this utility model as defined by the appended claims are effected.

What is claimed is:

1. A device for fixing the magnetic coil of drive unit, including a chassis, two coil bobbin brackets, and one magnetic coil, wherein, Two bobbin brackets (2) having at least one bobbin hook (2-1) on each of them are mounted on the chassis (50), the chassis has two locking slots;

The magnetic coil (3) is mounted between the two bobbin brackets (2);

A planger (1) is mounted adjacent to one end of the magnetic coil (3), and close to the other end, a magnet (6) is mounted.

2. The device for fixing the magnetic coil of drive unit according to claim 1, wherein, at least one coil positioning pin (4) is mounted on that coil bobbin bracket (2), close to which the said magnet (6) is mounted.

3. The device for fixing the magnetic coil of drive unit according to claim 1, wherein, the said magnet (6) is mounted on a magnet bracket (5).

* * * * *